US005778464A

United States Patent [19]

Chapple et al.

[11] Patent Number: 5,778,464

[45] Date of Patent: Jul. 14, 1998

[54] SHOWER AND/OR BATH APPARATUS

[75] Inventors: Bryn Lincoln Chapple; Sabina Iris Klose, both of Auckland, New Zealand

[73] Assignee: New Line Shower Screens Limited, Auckland, New Zealand

[21] Appl. No.: 619,310

[22] Filed: Mar. 21, 1996

[30] Foreign Application Priority Data

Mar. 21, 1995 [NZ] New Zealand ..... 270768

[51] Int. Cl.[6] ..... A47K 3/22

[52] U.S. Cl. ..... 4/596; 4/613; 4/584

[58] Field of Search ..... 4/612–614, 595, 4/584, 596; 52/34, 35

[56] References Cited

U.S. PATENT DOCUMENTS 3,588,925 6/1971 Kuypers et al. ..... 4/595

4,204,376 5/1980 Calvert ..... 52/35 X 4,228,552 10/1980 Weaver ..... 52/35

4,825,480 5/1989 Moore ..... 4/595

*Primary Examiner*—Charles E. Phillips

*Attorney, Agent, or Firm*—Dvorak & Orum

[57] ABSTRACT

An enclosure for one of a tray and bathroom tub where a spacer is attached to an upstanding flange provided on the enclosure. The upstanding flange abuts a room wall such that a wall liner overlaps the upstanding flange and is spaced from the flange thereby providing an air gap therebetween which reduces the likelihood of water to be drawn through capillary action between the wall liner and the upstanding flange.

5 Claims, 2 Drawing Sheets

SHOWER AND/OR BATH APPARATUS

BACKGROUND (1) Field of the Invention

This invention relates to shower and/or bath apparatus and, in particular, shower trays or baths fitted with additional joinery such as doors and/or provided with a wall lining in a potentially wet environment.

(2) Description of the Prior Art

A number of current shower trays or similar bath units used in conjunction with showers are provided in the marketplace. Many of these include a sill on which doors with a similar joinery may be fitted to enclose the cubicle. Additionally, many such units are used in conjunction with the wall lining which terminates with the connection to the shower tray or bath unit which, although generally not provided in a region accessible by water ponded in the shower tray or bath, may still be in a relatively wet environment and subject to spray from a shower nozzle and/or water splashed from accumulated water in the base of the shower or bath.

The prior art shower and/or bath units often suffer from leakage in the region of the connection between the sill of the shower base or bath and the joinery fitted onto that sill or, alternatively or additionally, may leak water into framework around the cubicle by passing behind the wall lining.

Such leakage around the doors fitted to the cubicle may be little more than a nuisance in many instances, however, particularly in the case of leakage behind the wall lining, a potential exists to damage the framework and structure of a building through water damage and the egress of water to regions in which such water is undesirable.

During fitment of prior art shower bases and bath cubicles, a large use is made of sealants such as silicone sealants to protect against such passage of water. However, the silicone sealants themselves may harden and become brittle with age or have regions in which the silicone sealant is weaker, thinner or missed entirely to form an incomplete seal.

OBJECT OF THE INVENTION

Therefore, it is an object of the present invention to provide a shower or bath apparatus which may overcome some of these difficulties of the prior art and/or at least provide the public with a useful choice.

SUMMARY OF THE INVENTION

Accordingly, in the first aspect, the invention consists in a shower tray or bath comprising:

a shower tray or bath portion;

a sill about at least a portion of the perimeter of said shower base or bath and raised therefrom; and, a recess in at least a portion of said sill and having an opening into an interior side of said sill adjacent and above said shower base or bath.

Accordingly, in a second aspect, the invention consists in a shower tray or bath comprising:

a shower base or bath;

an upstanding flange about at least a portion of the perimeter of said shower base or bath; and a spacer on or adjacent a top edge of said upstanding flange and extending at least partially transversely from said flange to space a partially overlapping wall lining from an upper portion of said flange adjacent said top edge of said flange.

Accordingly, in a third aspect, the invention consists in a method of installing a shower tray or bath comprising:

locating a shower base or bath having an upstanding flange about at least a portion of the perimeter of said shower base or bath;

placing said upstanding flange adjacent a wall;

providing a spacer on or adjacent said top edge of said upstanding flange; and, positioning a wall lining against said spacer such that an upper portion of said upstanding flange adjacent said top edge is spaced from said wall lining to provide an air gap.

Further aspects of this invention may become apparent to those skilled in the art to which the invention relates upon reading the following description.

BRIEF DESCRIPTION OF THE DRAWINGS

The description of preferred embodiments will now be provided with reference to the following drawings in which.

DETAILED DESCRIPTION OF PREFERRED EMBODIMENTS

Figure 1:
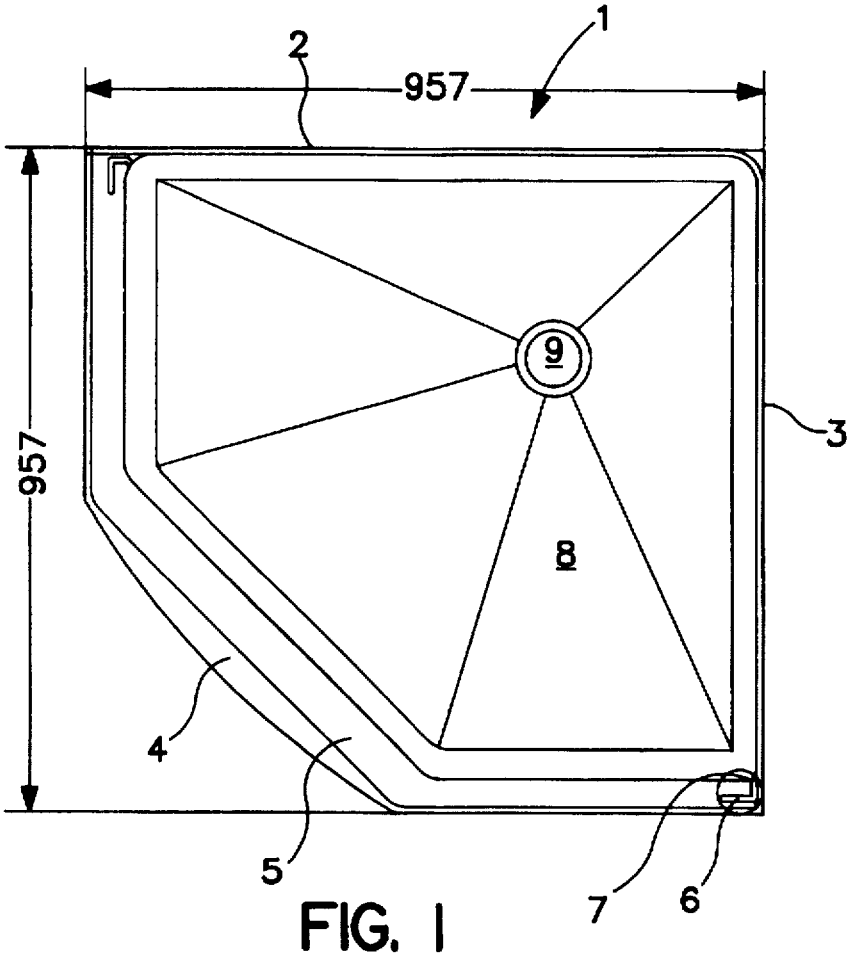
FIG. 1: shows a plan view of a shower tray in accordance with one embodiment of the apparatus.

Referring to the drawings, the invention can be seen to reside in a shower tray or bath 1 as shown in FIG. 1. In the description of the preferred embodiments, reference will be made to a shower tray 1, however, it should be noted that other apparatus and particular baths, tubs and the like, may also incorporate this invention where suitable.

This preferred embodiment of the shower tray 1 is designed to be placed in a corner of the room such that sides 2 and 3 of the apparatus 1 are placed adjacent walls within the room. A further portion 4 is placed on an interior side of the apparatus 1 protruding into the room and has a sill 5 to which the shower doors or similar apparatus may be fitted.

In this embodiment, a recess 6 is provided within a portion of the sill 5 to act as a drainage channel. The recess 6 has an opening 7 to allow the flow of water from the recess 6 back into the interior side of the sill 5 and down into the base 8 of the apparatus 1. This may then allow drainage back into the drain 9 at a low point in the base 8.

It can be seen in this preferred embodiment, the recess 6 is placed adjacent an end of the sill 5 and, in this embodiment, two such drainage portions are provided adjacent each end of the sill 5 at an intersection between the sill 5 and a portion of the apparatus 1 to lie adjacent a wall 2 or 3.

In use, prior art methods of construction have provided doors or similar apparatus placed on the sill 5 which has a C-shaped channel running along the sill 5 so that the ends of the arms of the channel reside on the sill 5 with the back of the channel uppermost and separated from the sill 5. Adjacent the corners of the sill where it resides against the walls 2 and 3, channels are often provided as part of the door apparatus, so that the door or similar apparatus may fit within the channel. This channel running down the walls 2 or 3 adjacent the end of the sill 5 is generally placed with the arms of the channel extending outwardly from the wall to engage the door. It is recognised in such prior art constructions that some water will run along the face of the door and into the channel against the walls 2 and 3. This water then flows down onto the channel placed on the sill 5 and this apparatus generally provides a drainage hole in the upper surface of the channel so that the water may flow into the space between the legs of the channel sitting on the sill 5. Such typical constructions then provide for the use of silicone or similar sealants against the outer leg of the channel sitting on the sill 5, so that water cannot flow pass this sealant and onto the floor surrounding the apparatus 1.

However, such prior art constructions rely on the security of this silicone sealant so that sufficient pressure can build up within the channel sitting on the sill 5 to force the water back in past the inner leg of the channel and towards the interior of the shower tray. The reliance on a pressure system to pass the water into the interior of the shower tray places greater reliance and greater likelihood of finding weak spots in the sealant adjacent the outer leg of this base channel.

In the present invention, the recess portion 6 and its opening 7 back into the interior of the tray provides a specific drainage channel for the drainage of this water back into the interior of the tray. Although silicone sealants may still be used on the channel sitting on the sill 5, the drainage channel or recess 6 now allows a low pressure drainage back into the tray to reduce the likelihood of the passage of water to the outside edge of the apparatus 1 and onto this surrounding floor.

Figure 3:
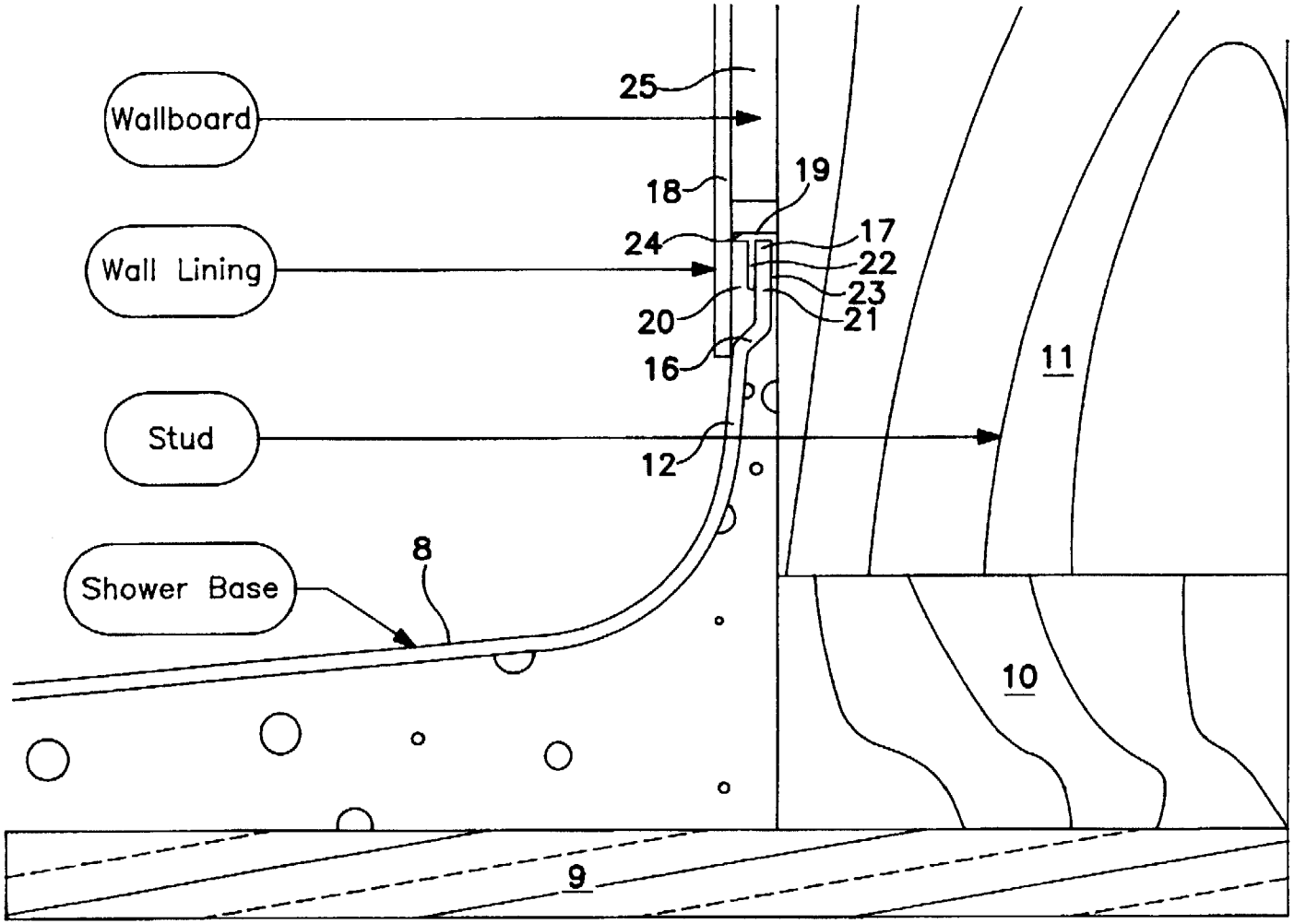
FIG. 3: shows a cross-sectional elevation through a shower tray in accordance with a further embodiment of the apparatus adjacent a wall.

Turning now to FIG. 3, the connection between the shower tray 8 and the wall 3 is shown in cross-section. A typical arrangement is the provision of a floor 9, a bottom plate 10 and spaced apart studs 11 to form the construction of the room in which the shower tray 8 is housed. Of course, alternative arrangements exist and may still be used in conjunction with this apparatus.

It can be seen that the shower base 8 turns into an upstanding flange 12 which is provided about that portion of the perimeter of the shower tray 8 adjacent the walls 2 and 3. In addition, the preferred form provides a step 16 in the upstanding flange intermediate of a top edge 17 of the flange 12 and the base 8 of the shower tray. The step 16 allows for some accommodation of the wall lining 18 to extending pass the top edge 17 of the flange 12 without the formation of a shadow line from a gap between the lining 18 and flange 12.

In this present invention, a spacing means 19 is provided on or adjacent the top edge 17 to space the wall lining 18 from this top edge 17 and create an air gap 20 between the wall lining 18 and an upper portion 21 of the flange 12 adjacent the top edge 17.

The spacer 19 may be provided by any convenient means and in this particular embodiment is shown as a separate portion having legs 22 and 23 to engage about the upper portion 21 and an inwardly directed flange 24 to provide the necessary spacing between the wall lining 18 and the upper portion of the flange 21.

It can be also seen that the spacer 19 is provided with an upper surface created by the flange 24 on or adjacent which a wallboard 25 may reside.

In the preferred form of the invention, the spacer 19 as provided by the section having legs 22, 23 and flange 24 is provided as a continuous section from relatively resiliently flexible material so that it may be tightly squeezed over the top edge 17 of the flange 12 and form a reasonable seal at that point. Alternatively it may be desirable to provide an inwardly directed flange similar to the flange 24 integral with the top edge 17 of the upstanding flange 12 as part of the shower tray itself. In further alternatives, the spacer 19 could be provided by a block of material placed adjacent the top edge 17.

In use, prior art showers merely provided for the wall lining to lie adjacent the upper portion 21 of the shower tray 8 and provided a bead of silicone therebetween to create a seal. However, capillary action is likely between the lining 18 and the upper portion 21 and this can draw moisture up to the bead of silicone. Provided the silicone is in good repair and no portions are missed, the silicone may well seal this adequately. However, should there be any mistakes in the placement of the silicone so that small gaps appear or should the silicone sealant age with time and become brittle and cracked, water may seep past the silicone and into the wall space. This can create damage to the remainder of the structure of the house such as the studs 11, bottom plate 10 and floor 9.

In this present invention, the creation of the air gap 20 stops or minimises the likelihood of capillary action between the wall lining 18 and the flange 12 of the shower tray 8. If it is desired, a silicone sealant may be used in conjunction with the apparatus, however, this may prove unnecessary with the provision of the air gap stopping the climbing of water up behind the wall lining 18.

In addition, should any water manage to reside in the air gap 20, such water is likely to travel along the step 16 provided on the preferred form of the invention towards the ends of the wall lining 18 at which the sill 5 is provided. At these points, any excess water that has managed to get into this gap 20 may drain down into the recess 6 forming the drainage channel as described previously.

The passage of water along the step 16 in the region of the air gap 20 is still relatively sealed off from the remainder of the wall 3 through the particular form of the provision of the spacer 19. The passage of water up the flange portion 21 intermediate of the legs 22 and 23 of the spacer 19 is a difficult path for water flow and the only likely point of passage for water from the air gap 20 other than into the drainage channel 6 is a requirement for the water to get between the inwardly turned flange 24 and the wall lining 18.

Thus it can be seen that this connection between the shower tray or bath 8 and the wall 3 and the method of construction involved providing the shower tray 8 and placing it adjacent the wall with the spacer 19 to space the wall lining 18 from the upstanding flange portion 21 creates an air gap which will limit or eliminate the passage of water between the wall lining 18 over the upper edge 17 of the tray or bath 8. This connection may work in conjunction with the previously described drainage channel 6 provided in the sill 5 of the apparatus as well.

Although the step 16 reduces the visual discontinuity between the flange 12 and lining 18 and provides a specific drainage path, the spacer alone is sufficient for the invention to inhibit the passage of water into the supporting wall.

Figure 2:
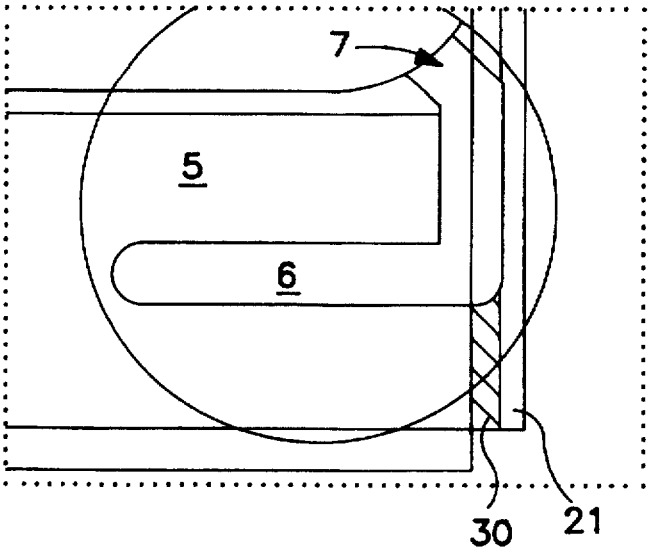
FIG. 2: shows a plan view of a portion of the apparatus of FIG. 1.

When both the spacer element for the wall lining and the drainage channels 6 and 7 are provided on the same unit, it may be necessary to fill the area 30 as shown on FIG. 2. The plan view in FIG. 2 shows the upstand flange 21 and the region 30 substantially corresponds with the top of the step 16 should this be provided all the way to the outer edge of the shower tray. Where this is adjacent the drainage channel 6, it may be necessary to inhibit the further passage of water along this step pass the drainage 6 and to encourage the water into the drainage channel 6 and out the outlet 7 into the shower tray.

This region 30 may be filled in any suitable manner such as by silicon sealant or, in the preferred form, the flange 21 may be thickened in this region to take up the space provided along the remainder of this flange by the spacer such that the flange 21 substantially abuts the wall liner in this region.

Thus it can be seen that the invention provides a shower tray or bath and a method of constructing such a shower or bath installation which overcomes many of the problems in sealing prior art apparatus.

Wherein the foregoing description reference has been made to specific components or integers of the invention having known equivalents then such equivalents are herein incorporated as if individually set forth.

Although this invention has been described by way of example and with reference to possible embodiments thereof it is to be understood that modifications or improvements may be made thereto without departing from the scope or spirit of the invention.

We claim:

1. An enclosure for use with one of a shower tray and bathroom tub supported by a floor and at least two walls comprising:

a base delimited by a perimeter thereof and having an upstanding flange about at least a portion of the perimeter of said base said upstanding flange having a top edge;

a planar wall lining for covering each respective wall, said lining extending downwardly beyond said upstanding flange such that it contacts said base;

a resiliently flexible spacer on said top edge of said upstanding flange, said spacer including a portion extending transversely towards said lining with respect to said upstanding flange in order to create an air space between an upper portion of said upstanding flange and said wall lining and to create a water-tight seal between the base and wall lining without the use of sealants.

2. The enclosure as claimed in claim 1 wherein said upstanding flange is stepped intermediate of said base and said top edge of said flange such that a bottom edge of said wall lining is one of resting on and adjacent to said step.

3. The enclosure as claimed in claim 1 wherein said spacer comprises a connection portion which connects to said top edge of said upstanding flange and a spacing flange extending from said connection portion in a substantially transversely and inwardly direction toward said wall lining.

4. The enclosure as claimed in claim 1 wherein said transverse portion of said spacer comprises an integrally formed flange which is inwardly turned toward said wall lining approximate said top edge of said upstanding flange.

5. The enclosure as claimed in claim 1 wherein said transversely extending portion of said spacer has an upper surface, which said surface faces against a wallboard.

* * * * *